US006206101B1

(12) United States Patent
Bakke

(10) Patent No.: US 6,206,101 B1
(45) Date of Patent: Mar. 27, 2001

(54) METHOD AND DEVICE FOR FACILITATING THE INSERTION OF A COILED TUBE INTO A WELL AND FOR LOOSENING STUCK OBJECTS IN A WELL

(75) Inventor: Stig Bakke, Ålgård (NO)

(73) Assignee: Bakke Technology AS, Algard (NO)

( * ) Notice: Subject to any disclaimer, the term of this patent is extended or adjusted under 35 U.S.C. 154(b) by 0 days.

(21) Appl. No.: 09/194,974

(22) PCT Filed: Jun. 6, 1997

(86) PCT No.: PCT/NO97/00147

§ 371 Date: Nov. 25, 1998

§ 102(e) Date: Nov. 25, 1998

(87) PCT Pub. No.: WO97/46791

PCT Pub. Date: Dec. 11, 1997

(30) Foreign Application Priority Data

Jun. 7, 1996 (NO) ..... 962429

(51) Int. Cl.[7] ..... E21B 31/00
(52) U.S. Cl. ..... 166/301
(58) Field of Search ..... 166/301, 385, 166/178; 175/296

(56) References Cited

U.S. PATENT DOCUMENTS 3,570,611 * 3/1971 Riziuc et al. .
4,171,727 10/1979 Tkach et al. .
4,384,625 5/1983 Roper et al. .
4,807,709 * 2/1989 Falgout, Sr. et al. .
4,834,193 5/1989 Leitko, Jr. et al. .
4,865,125 9/1989 De Cuir .
5,156,223 10/1992 Hipp .
5,180,012 * 1/1993 Crawford .
5,647,445 * 7/1997 Puchala .

FOREIGN PATENT DOCUMENTS 0 333 484 9/1989 (EP) ..... E21B/7/24
515630 1/1985 (NO) ..... E02D/17/00

* cited by examiner

*Primary Examiner*—Robert E. Pezzuto
*Assistant Examiner*—Kristine M. Markovich
(74) *Attorney, Agent, or Firm*—Head, Johnson & Kachigian

(57) ABSTRACT

Method for overcoming friction between a coiled tube and the wall of a well by an oil- or gas well, and for enabling application of impact energy to loosen stuck objects in a well. Pressure changes are applied to a liquid flowing in the coiled tube by periodically shutting off the liquid flow at or near the outlet of the coiled tube. Pressure changes, pressure strokes, are applied by means of a valve device comprising a valve body (31) arranged to seal against a valve seat (45) and to shut off the liquid flow whenever the flow rate exceeds a predetermined value, and to remain shut until the pressure in the liquid upstream of the valve body (31) is lower than a predetermined value, and that the valve body (31) has a slide (3) arranged thereto, which is arranged to open for a liquid flow past the valve body (31), to reduce, thereby, the pressure in the liquid upstream of the valve body (31) whenever the pressure in the liquid upstream of the valve body (31) exceeds a predetermined value. A damping device in which pistons in the form of collars (25, 26), channels (27, 28) and check valves (29, 30) are moved in annular spaces (17, 18, 19) filled with liquid, contributes to the valve device being closed long enough for a pressure rise to spread in the liquid in the coiled tube, and being open long enough for full liquid flow to be established before the next shut-off.

2 Claims, 5 Drawing Sheets

METHOD AND DEVICE FOR FACILITATING THE INSERTION OF A COILED TUBE INTO A WELL AND FOR LOOSENING STUCK OBJECTS IN A WELL

CROSS-REFERENCE TO RELATED APPLICATIONS

This application claims priority to PCT Application No. PCT/NO97/00147 filed Jun. 6, 1997 which claims priority from Norwegian Patent Application No. 962429 filed Jun. 6, 1996.

BACKGROUND OF THE INVENTION

The invention relates to a method and a device for facilitating the insertion of a coiled tube into an oil or gas well, and for applying of impact energy to stuck objects in an oil or gas well.

On inserting a coiled tube into an oil or gas well, in the following referred to as a well, the length of insertion is limited by friction between the coiled tube and the wall of the well. Even if the coiled tube is straightened in a separate straightening apparatus before being introduced into the well, it will adopt the form of a wave or a helix in the well. As the coiled tube is being pushed further and further down the well, and there are more points of contact between the coiled tube and the wall of the well, the total friction increases to a level at which the end of the coiled tube does not proceed further into the well. Further supply of coiled tube only leads to more turns being formed in the helix adopted by the coiled tube.

As is quite natural, the problem arises especially in wells of long horizontal stretches, in which weights at the end of the coiled tube will not contribute to stretching out the coiled tube.

It is known to mount a remotely controlled, motor driven propulsion device, a well tractor, at the end of the coiled tube to draw the coiled tube into the well. A well tractor is expensive and complex, and operational disturbances may easily occur. Furthermore, it is difficult to construct well tractors which are able to proceed and provide sufficient force in wells of small cross-sections. The cross-section is always smallest at the innermost/downmost part of a well, and long wells may also have the smallest cross-sections.

Objects that are stuck in a well, are most commonly loosened by applying impact energy to them. An impact tool which has been arranged to a drill string or a coiled tube, is inserted down to the stuck object and is activated. Known impact tools use a pre-tensioned spring which accelerates a mass, a hammer, which after having achieved appropriate speed, strikes against a stop transferring impact energy to the stuck object. Before each stroke the spring is tensioned by means of a hydraulic mechanism which is activated by a pressure liquid in the drill string or the coiled tube. The spring energy is released when the pre-tensioning has reached a predetermined value. A drawback of this known solution is that very powerful and space-consuming springs have to be provided to achieve the required impact energy. Another known type of impact tool is periodically extended and lifts the drill string or coiled tube which is above the impact tool, and then lets the drill string or coiled tube drop again, so that the mass of the drill string or the coiled tube causes a hammer effect. This type of impact tool has the unfavourable effect that impacts are transferred to the hole drill string or coiled tube in such a way that the couplings and other equipment arranged thereto, may be damaged.

The object of the invention is to provide a method and a simple, inexpensive device for facilitating the insertion of a coiled tube into a well, and for applying impact energy to objects which are stuck in a well. The aim is reached through features as indicated in the following description and subsequent claims.

According to the invention the aim is reached through applying impact changes or pressure strokes to a liquid flowing through a coiled tube or drill string. A pressure stroke in a coiled tube will contribute to briefly overcoming frictional forces between a coiled tube and the wall of the well, so that the coiled tube may be introduced a little further into the well by each pressure stroke.

Pressure strokes may be transferred to a stuck object by the coiled tube or drill string in a known manner being lead into contact with, and possibly attached to, the stuck object. Pressure strokes may also be used to accelerate a mass, a hammer, which in a manner known in itself, strikes against a stop which transfers impact energy to the stuck object.

Pressure strokes is achieved, according to the invention, by periodical shut-off of a liquid flow in the coiled tube or drill string, a valve device being located at or near the outlet of the coiled spring. The valve device may advantageously be such, that it is activated once the liquid flow exceeds a predetermined flow rate. Then it is possible to carry out ordinary well operations by a lower and normal flow rate, and if a need for pressure changes arises, the flow rate is increased to activate the valve device.

To achieve the best possible effect, the valve device should be such, that after having shut off, it remains shut long enough for the pressure rise to spread in the liquid, and so that after having opened, it remains open long enough to re-establish full flow rate.

BRIEF DESCRIPTION OF THE DRAWINGS

An embodiment of a preferred valve device for the periodical shut-off of the liquid flow in a coiled tube or a drill string is described in the following with reference to the accompanying drawings, in which FIG. 1 schematically shows a sectional side view of a part of a valve device in its opened starting position.

DETAILED DESCRIPTION OF THE PREFERRED EMBODIMENT

Figure 1:
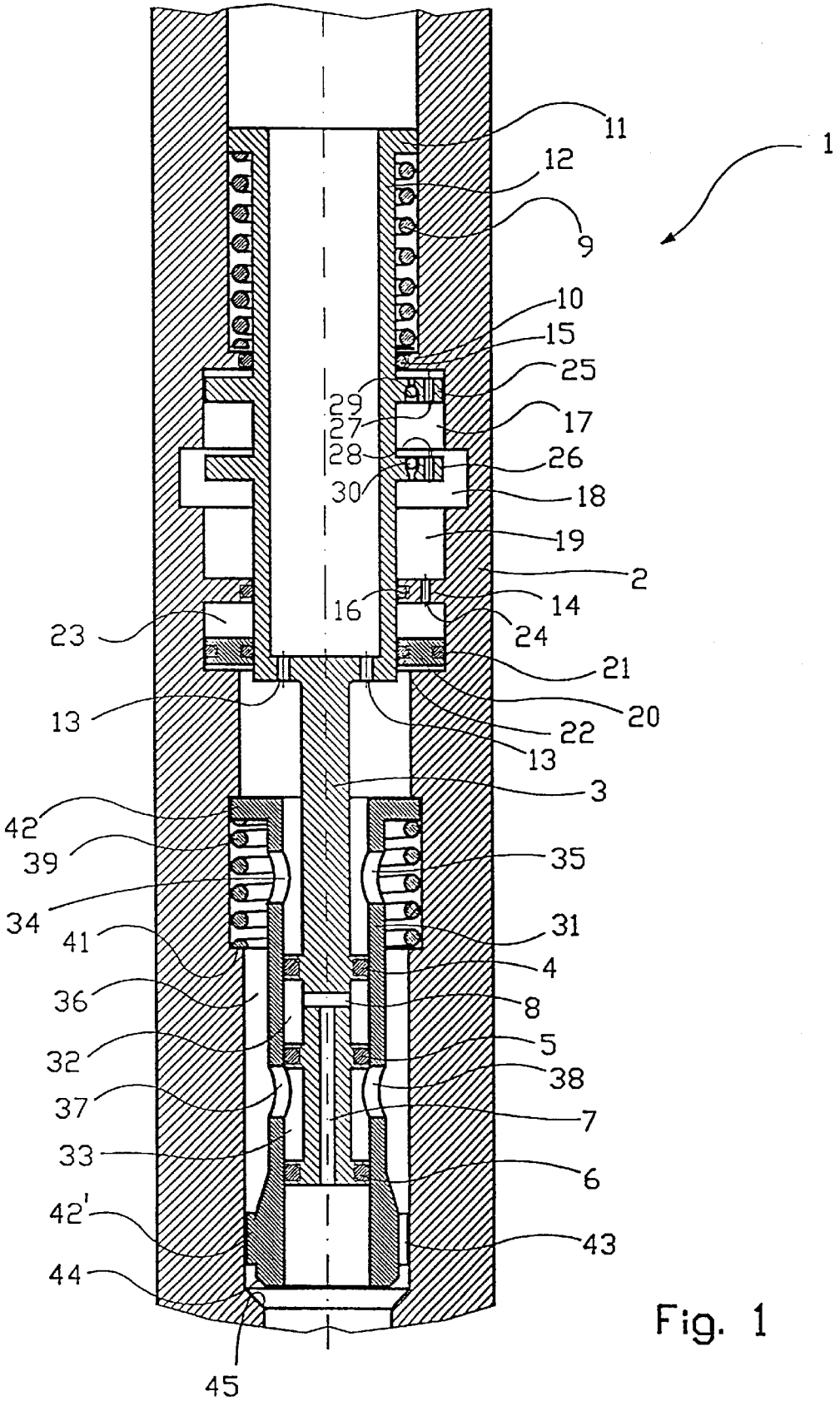

In FIG. 1 reference numeral 1 indicates a valve device which can open and close periodically for a liquid flow. The valve device 1 which is shown in vertical position, comprises an external tubular housing 2, in which are provided movable parts.

Before the invention is described further, it should be mentioned that the shown housing 2 and said movable parts are shown schematically. This provides a clearly set out figure, and the way of working of the invention will be easily understood. In practice, the housing 2 will be divided into several parts which are typically joined up as a housing 2 by means of threaded couplings which are made pressure tight by means of seals. Shoulders and other items which in the figure appear as parts of the housing 2, may in practice be separate parts which in known manner are secured inside the housing 2. Further, movable parts in the housing 2 may in the same way be made up of several parts. The division is necessary to enable production of the valve device in machine tools or other production equipment. Division is also necessary to enable mounting of movable parts in the housing 2. It is common that down-hole tools have an external tubular housing, and that within the housing are arranged both fixed and movable parts. A skilled person will undertake a division suitable for the equipment that he wants to use for the production, and at the same time take into account that the device shall be mountable and dismountable.

The housing 2 is further shown without end couplings as such are well known from other down-hole equipment.

Inside the housing 2 is arranged an axially displaceable slide 3 which at its lower end is provided externally with three separate annular seals 4, 5, 6 mentioned from the top downwards. A channel 7 in the slide 3 ends at its bottom end in the lower end surface of the slide 3, and at the top in a transverse hole in the slide 3, between the seals 4, 5.

The slide 3 is retained in an upper starting position by a pre-tensioned spring 9 which is supported by a first annular shoulder 10 inside the housing 2, and works on the underside of an external shoulder 11 at the upper end of an axially displaceable cylindrical sleeve 12, which at its lower end is attached to the slide 3. The sleeve 12 is at its bottom provided with openings 13, so that liquid can flow through the sleeve 12. Below the shoulder 10 there is, inside the housing 2, a second annular shoulder 14. The shoulders 10, 14 are provided with respectively seal 15 and 16, which are arranged to form a sliding tightening against the outer surface of the sleeve 12. The shoulders 10, 14 define an upper annular space 17, a central annular space 18 and a lower annular space 19. At the central annular space 18 the housing 2 has a larger internal diameter than the adjacent annular spaces 17 and 19. The housing 2 may have the same internal diameter at the annular space 17 as at the annular space 19.

Below the shoulder 14 there is in the annular space between the housing 2 and the sleeve 12 an annular piston 20 with seals 21, 22 which rest tighteningly against the housing 2 and the sleeve 12, respectively. The underside of the shoulder 14 and the top side of the piston 20 thus define a portion 23 of the annular space between the housing 2 and the sleeve 12. A channel 24 in the shoulder 14 connects the portion 23 of the annular space with the annular spaces 17, 18, 19 above the shoulder 14.

The annular spaces 17, 18, 19 and 23 are filled with hydraulic oil or another liquid. The underside of the piston 20 is exposed to the liquid which is conveyed by the valve device 1, and ensures that always the same pressure prevails in the liquid in the annular spaces 17, 18, 19 and 23 as in the rest of the valve device 1. The annular space 23 with the piston 20 serves as a reservoir and a pressure accumulator for the annular spaces 17, 18, 19.

The sleeve 12 is externally provided with an upper collar 25 and a lower collar 26 which are both located between the shoulders 10, 14. The stroke length of the sleeve 12 is restricted by the collars 25, 26 abutting the shoulders 10, 14. The diameter of the upper collar 25 is adapted to the diameter of the housing 2 at the upper annular space 17, and the diameter of the lower collar 26 is adapted to the diameter of the housing 2 at the lower annular space 19, so that there is little clearance between the housing 2 and the collars 25, 26. The distance between the collars 25, 26 is such, that they may be brought, separately or simultaneously, into the central annular space 18 by displacing the sleeve 12 axially in the housing 2. When the collars 25, 26 are in the annular space 18, there will, due to the larger outer diameter of the annular space 18, be a greater clearance outwards towards the housing 2, than when the collars 25, 26 are in the annular spaces 17 and 19, respectively.

In each of the collars 25, 26 has been provided, in the form of a relatively narrow channel 27 and 28, respectively, or in another manner, a limited cross-section, by which liquid may flow through or past the collars 25, 26 when these are moved within the annular space 17 and 19, respectively. In each of the collars 25, 26 is further arranged a check valve 29 and 30, respectively, of a larger cross-sections than the channels 27, 28. The flow resistance past the collars 25, 26 thus become direction dependent when the collars 25, 26 are moved in the annular space 17 and the annular space 19, respectively. In one direction liquid may pass the collar 25 through both channel 27 and check valve 29, and the flow resistance is small. In the opposite direction liquid may only pass the collar 25 in a restricted cross-section provided by the channel 27 and the clearance between the collar 25 and the housing 2. When the collar 25 is in the annular space 17, this provides great flow resistance. This is correspondingly also the case for the collar 26 when it is in the annular space 19.

The check valve 29 in the collar 25 is arranged to open for liquid from the upper side of the collar 25 to its underside. The check valve 30 is arranged opposite, to open for liquid from the underside of the collar 26 to its upper side. If the sleeve 12 is displaced, this entails great flow resistance for the one of the collars 25, 26 which is being moved in the direction towards the annular space 18, and little resistance for the collar 25, 26 which is simultaneously being moved in the direction from the annular space 18. A collar 25, 26 which is in the annular space 18, provides little flow resistance independently of the direction of motion, as liquid may pass outside the collar. If the sleeve 12 is subjected to a downward force which is greater than the force from the spring 9, the sleeve 12 (and thereby the slide 3) will move slowly downwards because of the flow resistance in the channel 27 in the collar 25. When the collar 25 enters the annular space 18, the flow resistance is reduced, and the sleeve 12 is quickly moved to a lower end-position, in which the lower collar 26 abuts the shoulder 14, as the check valve 30 will open for the liquid flow. If the downward force is removed, the spring 9 will seek to bring the sleeve 12 and the slide 3 back into the upper position. The check valve 30 will then close, and the speed of the sleeve 12 is restricted by the flow resistance in the channel 28. The channels 27, 28 serve as flow resistors. The check valve 29 in the upper collar 25 will open for liquid flow, so that there will be little flow resistance when the collar 25 is displaced in the annular space 17. When the collar 26 enters the annular space 18, the flow resistance is reduced, and the sleeve 12 is quickly displaced towards the upper end-position.

An axially displaceable tubular valve body 31 encloses the lower part of the slide 3, so that the seals 4, 5, 6 form a sliding tightening against the inner surface of the valve body 31. The seals 4, 5, 6 thus define an upper annular space 32 and a lower annular space 33 between the slide 3 and the valve body 31, and thereby liquid cannot flow directly through the valve body 31. In the side wall of the valve body 31, above the area of the seal 4, are arranged gates 34, 35, so that liquid flowing into the upper end of the valve body 31, may flow through the gates 34 and 35 out into an annular space 36 between the valve body 31 and the housing 2. Further, in the side wall of the valve body 31, below the area of the seal 4, are arranged further gates 37, 38, so that liquid may flow from the annular space 36 into the annular space 32 or the annular space 33, depending on the position of the slide 3 relative to the valve body 31. A pre-tensioned spring 39, resting on the shoulder 41 inside the housing 2, works against the underside of an external shoulder 42 on the valve body 31, retaining the latter in an upper starting position.

Figure 4:
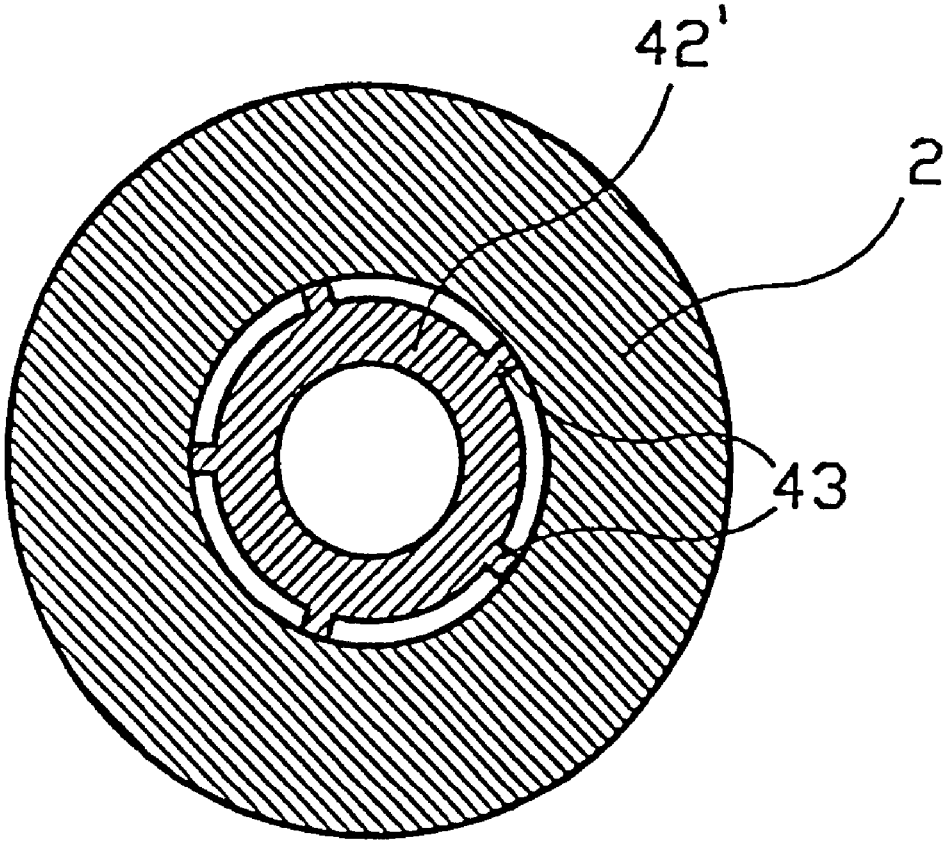
FIG. 4 schematically shows a cross-section of the housing and valve body of the valve device.

Below the gates 37, 38, the valve body 31 is provided with a flow restriction 42' in the form of an increased outer diameter, which limits the cross-section of the annular space 36 at the lower end of the valve body 31. At the flow restriction 42' the valve body 31 is provided with external ribs 43 slidably resting on the housing 2, see FIG. 4.

The lower end of the valve body 31 is provided with a seal surface 44 arranged to be capable of tightening against a valve seat 45 in the housing 2, when the valve body 31 is displaced to a lower position.

When both the slide 3 and the valve body 31 are in the starting position, the annular space 33 communicates with the annular space 36 through the gates 37, 38, as is shown in FIG. 1.

Liquid may flow into the upper end of the valve device 1, down through the sleeve 12, through the openings 13, into the valve body 31 at the upper end thereof, through the gates 34, 35, out into the annular space 36, past the flow restriction 42', further past the seal surface 44 and valve seat 45, out through the lower part of the valve device 1.

Figure 2:
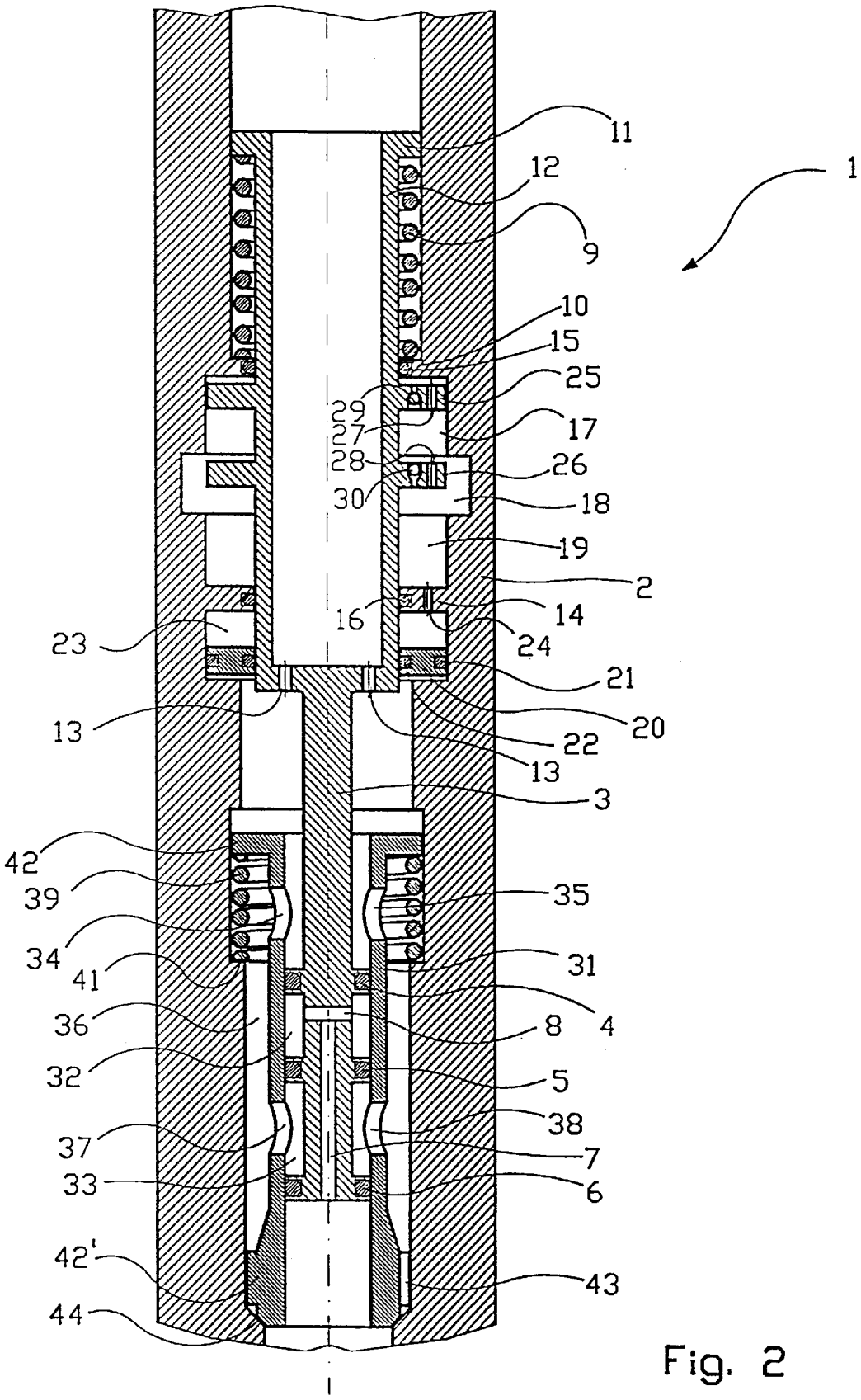
FIG. 2 shows the valve devised in closed position.

If the flow rate is increased, the flow restriction 42' will cause such a great pressure fall that a resulting force working on the valve body 31, will overcome the force from the spring 39 and displace the valve body 31 to a lower position, in which its sealing surface 44 seals against the valve seat 45, see FIG. 2.

The liquid flow through the valve device 1 comes to a stop, which results in a pressure rise in the liquid above the valve seat 45. An increasing pressure difference from the upper side to the underside of the valve seat 45 is caused, and this effects an increasing downward force which works on the valve body 31 and retains the seal surface 44 against the valve seat 45. It also effects an increasing downward force working on the slide 3. When the resulting force against the slide 3 exceeds the force from the spring 9, the slide 3 is displaced downwards, and the sleeve 12 is brought along.

At the beginning the slide 3 will be displaced slowly downwards because of the flow resistance when the collar 25 is displaced downwards in the annular space 17. After some time, greatly determined by the cross-section of the channel 27 and the length of the annular space 17, the collar 25 enters the annular space 18. The sleeve 12 and the slide 3 is then displaced quickly towards a lower position, as already explained.

Figure 3:
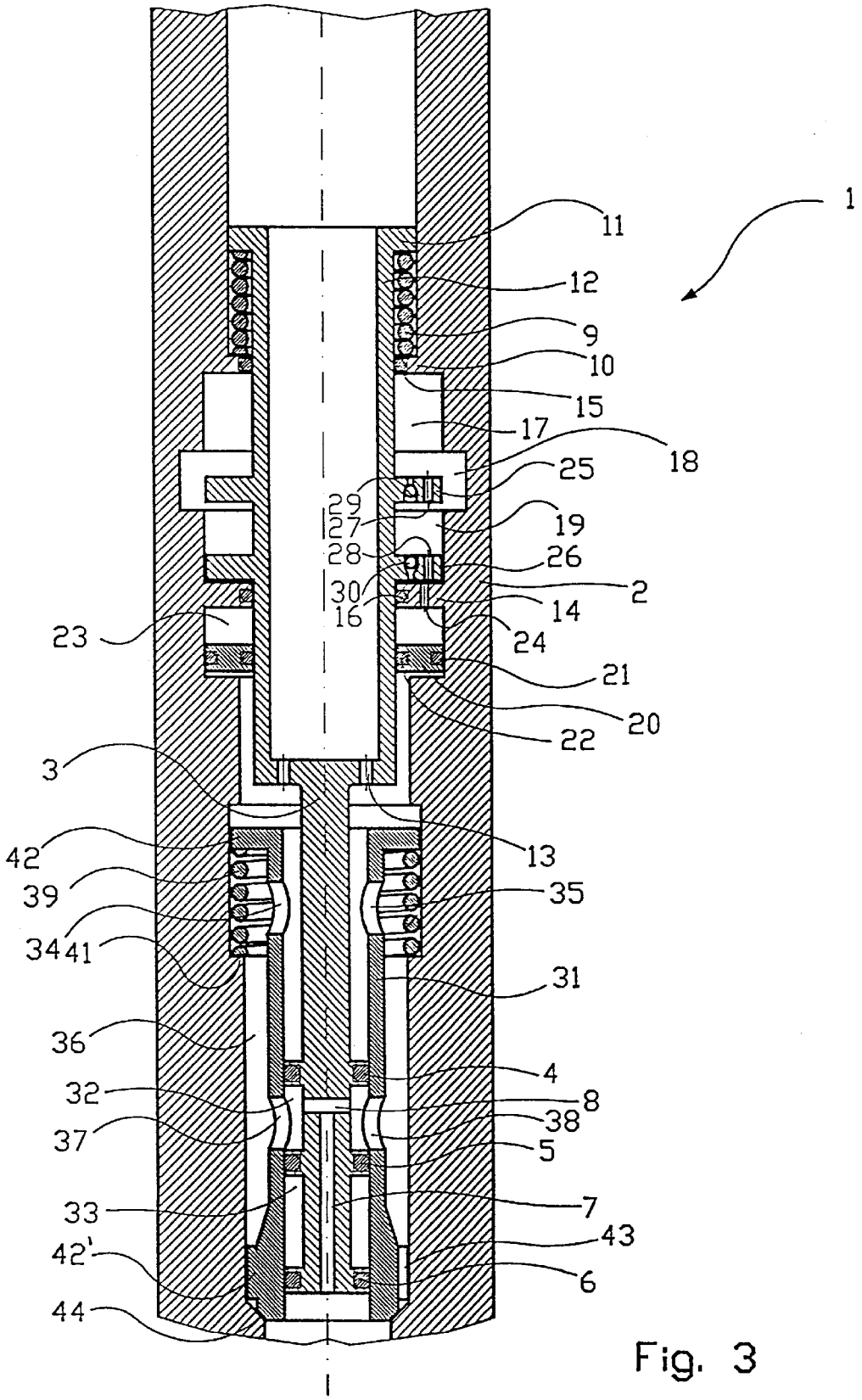
FIG. 3 shows the valve device as it is about to open and revert to its starting position.

As a consequence of the slide 3 being displaced downwards in the valve body 31, communication between the annular space 36 and the annular space 32 is established through the channels 37, 38, see FIG. 3. Liquid may then flow from the annular space 36 to the annular space 32 and further through the bore 8 and the channel 7 out through the lower part of the valve device 1.

The liquid flow established entails a pressure fall on the upper side of the valve seat 45, and the spring 39 will, after a short while, lift the valve body 31, so that it does not tighten against the valve seat 45.

Thereby, liquid may flow past the flow restriction 42 as well as through the gates 37, 38, the bore 8 and the channel 7, and the pressure may be equalized in the valve device 1.

The spring 9 seeks to lift the sleeve 12 and the slide 3 to the upper starting position, but the flow resistance of the collar 26 in the annular space 19 makes this happen slowly. After a while, which is greatly determined by the cross-section of the channel 28 and the length of the annular space 19, the collar 26 enters the annular space 18. The flow resistance is reduced as liquid may pass outside the collar 26, and the spring 9 quickly brings the sleeve 12 and the slide 3 to the upper starting position, see FIG. 1.

The process is periodically repeated as long as a sufficiently great liquid flow is being pressed through the valve device 1.

The collars 25, 26 with channels 27, 28, check valves 29, 30 and the annular spaces 17, 18, 19, filled with liquid, constitute a damping device limiting the speed of the valve body 31 during part of the movement of the valve body 31.

Figure 5:
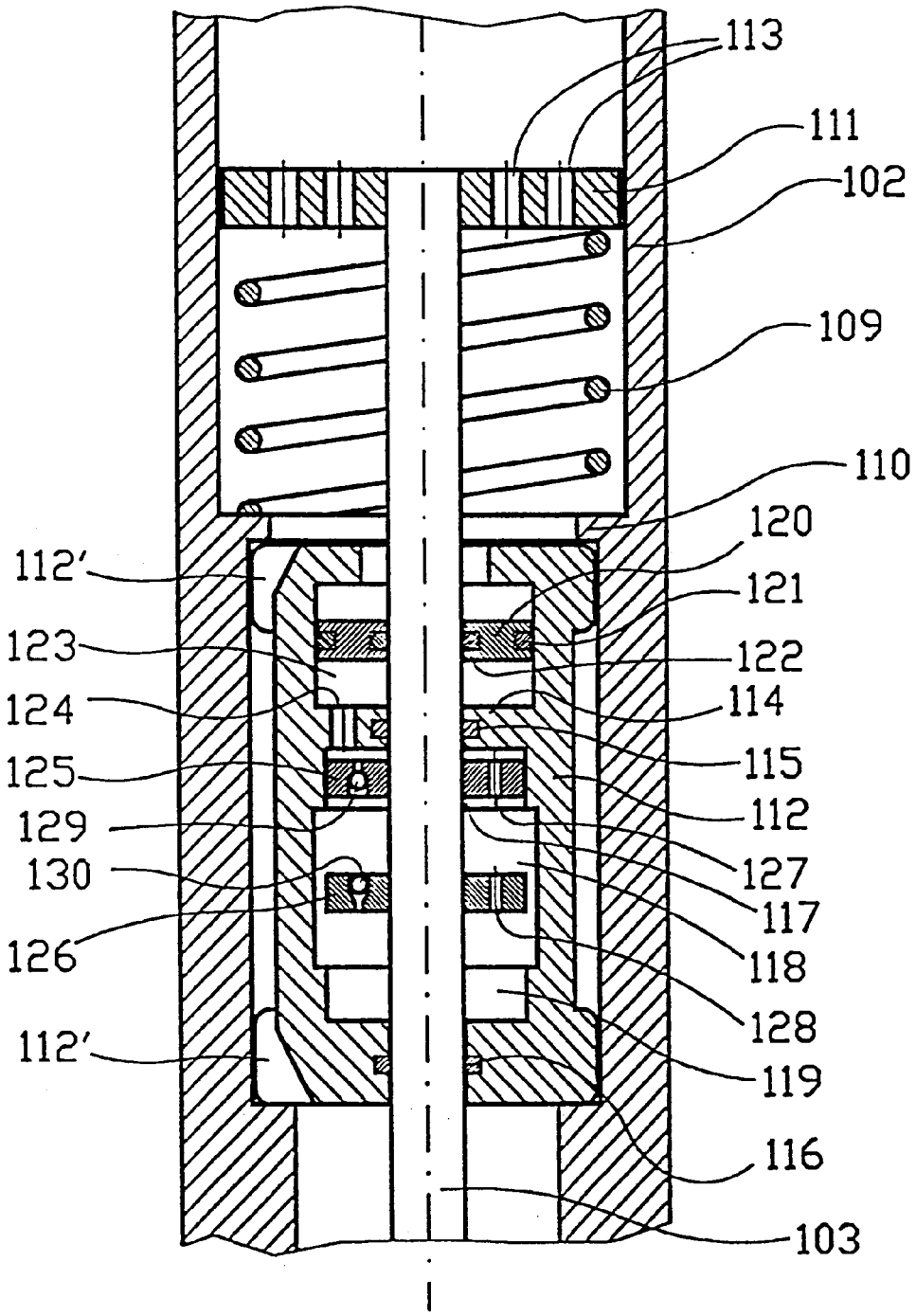
FIG. 5 schematically shows a cross-section of a damping device.

An alternative embodiment of a damping device is described in the following with reference to FIG. 5, in which reference numerals of values exceeding one hundred are used, and so that components having the same or corresponding functions as those of the damping device already described, have been given the same reference numerals plus one hundred. Thus, in FIG. 5, is shown a part of a tubular housing 102, corresponding to the housing 2, and in which the upper part of a slide 103, corresponding to the slide 3, is shown. The slide 103 is kept in an upper starting position by a pre-tensioned spring 109 which rests on an annular shoulder 110 inside the housing 102 and works against the underside of a plate 111 attached to the slide 103 at the upper end thereof. Liquid may pass the plate 111 through openings 113 in the plate 111.

Below the shoulder 110 there is provided in the housing 102 a concentric fixed sleeve 112. There is a clearance between the housing 102 and the sleeve 112, external radial lugs or ribs 112' supporting the sleeve 112 internally in the housing 102, so that liquid may pass outside the sleeve 112.

The slide 103 runs through the sleeve 112 which is open at its upper end. In the sleeve 112 is arranged a shoulder 114 with a seal 115 which slidingly tightens against the slide 103. At the lower end of the sleeve 112 is arranged a seal 116 with also tightens slidingly against the slide 103. The seals 115, 116 define an upper annular space 117, a central annular space 118 and a lower annular space 119 between the slide 103 and the sleeve 112. At the central annular space 118 the sleeve 112 has a larger internal diameter than at the adjacent annular spaces 117, 119. The sleeve 112 may have the same internal diameter at the annular space 117 as at the annular space 119.

Above the shoulder 114, in the sleeve 112 there is an annular piston 120 with seals 121, 122 slidingly tightening against the sleeve 112 and the slide 103, respectively. The underside of the piston 120 and the upper side of the shoulder 114 thus define a portion 123 of the annular space between the slide 103 and the sleeve 112. A channel 124 in the shoulder 114 connects the portion 123 of the annular space to the annular spaces 117, 118, 119 below the shoulder 114. The annular spaces 117, 118, 119 and the annular space portion 123 are filled with hydraulic oil or another liquid. The upper side of the piston 120 is exposed to the liquid conveyed in the valve device 1, and ensures that always the same pressure prevails in the liquid in the annular spaces 117, 118, 119 and 123 as in the rest of the valve device. The annular space portion 123 serves as reservoir and pressure accumulator for liquid in the annular spaces 117, 118, 119.

The slide 103 is externally provided with a fixed upper collar 125 and a fixed lower collar 126 located between the seals 115, 116. The diameter of the upper collar 125 is adapted to the annular space 117, and the diameter of the lower collar 126 is adapted to the annular space 119, so that there is little clearance between the sleeve 112 and the collars 125, 126. The distance between the collars 125, 126 is such that they may be brought, separately or simultaneously, into the central annular space 118 through axial displacement of the slide 103. When the collars 125, 126 are in the annular space 118, there will be larger clearance between the sleeve 112 and the collars 125, 126 than when the collars 125, 126 are in the annular space 117, 119.

In each of the collars 125, 126 is provided, in the form of a relatively narrow channel 127 and 128, respectively, a limited cross-section by way of which liquid may flow through or past the collars 125, 126 when these are moved in the annular space 117 and 119, respectively. The channels 127, 128 serve as flow restrictors. In each of the collars 125, 126 is further provided a check valve 129 and 130, respectively, of a larger cross-sections than the channels 127, 128. The flow resistance past the collars 125, 126 is thus direction dependent when the collars 125, 126 are in the annular space 117 and 119, respectively. When the slide is forced downwards by the pressure created when the valve body 31 closes, the annular spaces 117, 118, 119 filled with liquid, the collars 125, 126 with channels 127, 128 and check valves 129, 130, will delay the movement of the slide 103 in a manner corresponding to that explained for the annular spaces 17, 18, 19 and the collars 25, 26 with channels 27, 28 and check valves 29, 30.

What is claimed is:

1. A device for overcoming friction and applying impact energy to an object stuck within an oil or gas well, in order to loosen and disengage said stuck object through the application of pressure changes to a liquid flowing within the bore of a coilable tubing or a drill string, and wherein a valve body is adapted to seal against a valve seat and shut off the liquid flow whenever the flow rate exceeds a predetermined value, thus giving rise to a build-up of pressure in the liquid flow, until a pressure fall is caused upstream of the valve body, said valve body further is adapted to maintain the closed position thereof, shutting off the liquid flow, when the flow rate exceeds a predetermined value, and that the valve body is assigned a slide adapted to open for a liquid stream past the valve body, in order to reduce the pressure in the liquid upstream of the valve body, whenever the pressure in the liquid upstream of the valve body exceeds a predetermined value, and wherein a part of the valve body is assigned a damping device, restricting the speed of the valve body during part of the movements thereof from opened to closed and from closed to opened position, and wherein the damping device comprises at least one piston in the form of a collar providing resistance against being moved within an annular space filled with liquid, said collar being provided with a flow resistor in the form of a channel.

2. A device as claimed in claim 1, wherein the collar is provided with a check valve which for one flow direction allows liquid flow parallel to the liquid flow in the channel.

* * * * *